US007582003B1

(12) United States Patent
Trichak

(10) Patent No.: US 7,582,003 B1
(45) Date of Patent: Sep. 1, 2009

(54) ILLUMINATABLE AERODYNAMIC DISC OR SAUCER

(76) Inventor: Angelique M. Trichak, 1016 W. Madison - No. 4N, Chicago, IL (US) 60607

( * ) Notice: Subject to any disclaimer, the term of this patent is extended or adjusted under 35 U.S.C. 154(b) by 847 days.

(21) Appl. No.: 10/989,915

(22) Filed: Nov. 16, 2004

(51) Int. Cl.
*A63H 33/22* (2006.01)

(52) U.S. Cl. ..... 446/219; 446/46

(58) Field of Classification Search ..... 446/46, 446/47, 219, 48, 485, 41
See application file for complete search history.

(56) References Cited

U.S. PATENT DOCUMENTS 1,404,132 A * 1/1922 Manes ..... 446/46
2,659,178 A * 11/1953 Van Hartesveldt ..... 446/46
3,720,018 A * 3/1973 Peterson et al. ..... 446/47
3,751,846 A * 8/1973 Benjamin, Sr. ..... 446/197
3,786,246 A * 1/1974 Johnson et al. ..... 446/47
4,086,723 A * 5/1978 Strawick ..... 446/47
4,165,580 A * 8/1979 Miura ..... 446/46
4,207,702 A * 6/1980 Boatman et al. ..... 446/219
4,254,575 A * 3/1981 Gould ..... 446/46
4,255,895 A * 3/1981 LaBrecque ..... 446/47
5,083,799 A * 1/1992 Thill ..... 446/47
5,474,482 A * 12/1995 Davidson ..... 446/219
5,882,239 A * 3/1999 Trichak ..... 446/46
6,402,342 B1 * 6/2002 Chiang ..... 446/47
6,544,093 B2 * 4/2003 Komuro ..... 446/47
6,726,521 B2 * 4/2004 Peterson ..... 446/46
6,860,783 B1 * 3/2005 Kucha et al. ..... 446/47

* cited by examiner

*Primary Examiner*—Gene Kim
*Assistant Examiner*—Urszula M Cegielnik
(74) *Attorney, Agent, or Firm*—Dillis V. Allen, Esq.

(57) ABSTRACT

An illuminatable translucent disc that spins and flies when thrown including chemiluminescent receiving clips that extend radially across the disc so when the disc spins in darkness, the entire disc appears illuminated. The central disc portion has a smooth lower surface to not only improve aerodynamics but also to enhance finger spinning.

13 Claims, 2 Drawing Sheets

ILLUMINATABLE AERODYNAMIC DISC OR SAUCER

BACKGROUND OF THE INVENTION

Light emitting aerodynamic discs have been suggested in the past to enable disc throwing and catching during dusk and even nighttime hours. These have included phosphorous light emitting coatings for the disc and more frequently have included discs that have receptacles for removably mounting chemiluminescent tubes. These tubes are fairly standard in construction and contain a flexible outer tube and an inner frangible wall that separates the tube into two compartments, each containing one of the chemiluminescent compositions that when mixed emit light for four or more hours depending upon the volume and strength of the chemiluminescent compositions.

One drawback with the plastic discs that have compartments to hold the removable chemiluminescent tubes is that they affect the aerodynamics of the discs and because the discs frequently are abused by hitting fixed objects, such as trees and buildings, the chemiluminescent tubes are likely to fall out of the discs.

A more significant problem in these prior flying discs that carry light emitting devices is that they do not illuminate the entire disc as it spins, and while this is not particularly significant for purposes of throwing the disc, it does interfere with catching the disc because the catcher cannot determine the location of the outer rim of the disc which is usually utilized for catching, as well as for throwing purposes.

Another comment on these prior illuminatable discs is that they are far too complicated and costly for the flying disc market.

The following is a list of United States Patents resulting from a prior art search:

| Inventor | Patent No. | Issued |
|---|---|---|
| Peterson, et al. | 3,720,018 | Mar. 13, 1973 |
| Michael | 3,948,523 | Apr. 6, 1976 |
| Strawick | 4,086,723 | May 2, 1978 |
| Psyras | 4,132,031 | Jan. 2, 1979 |
| Miller, et al. | 4,135,324 | Jan. 23, 1979 |
| Sampietro | 4,145,839 | Mar. 27, 1979 |
| Boatman, et al. | 4,207,702 | Jun. 17, 1980 |
| Gould | 4,254,575 | Mar. 10, 1981 |
| Gudgel | 4,301,616 | Nov. 24, 1981 |
| Kutnyak | 4,431,196 | Feb. 14, 1984 |
| O'Riley | 4,607,850 | Aug. 26, 1986 |
| Riccardi, et al. | 5,348,509 | Sep. 20, 1994 |
| Stamos | 5,536,195 | Jul. 16, 1996 |
| Trichak | 5,882,239 | Mar. 16, 1999 |
| Chiang | 6,402,342 | Jun. 11, 2002 |
| Komuro | 6,554,093 | Apr. 8, 2003 |
| Patent Application Publication | | |
| Peterson | Publication No. U.S. 2003/0162470<br>Publication Date: Aug. 28, 2003 | |

The Boatman, et al., U.S. Pat. No. 4,207,702, shows a saucer-shaped toy that has a plurality of central clips 32 that hold a straight chemiluminescent light stick. In this design, the light stick can fall out of the disc and illuminates only a small central portion of the disc.

The Strawick, U.S. Pat. No. 4,086,723, shows a design similar to Boatman, et al.

The Gould, U.S. Pat. No. 4,254,575, shows an aerodynamic flying saucer with a chemiluminescent ring tube that when positioned in an annular ring, fits within the disc. This configuration, when the chemiluminescent tube is activated and the disc is thrown, illuminates only a small part of the perimeter of the disc so that the disc appears as a thin lighted ring.

The Stamos, U.S. Pat. No. 5,536,195 shows an illuminated flying disc having a flexible chemiluminescent tube threaded through apertures in the top of the disc.

The O'Riley, U.S. Pat. No. 4,607,850 shows a lighted sport disc having what appears to be a planar uninterrupted lower surface. The battery 20 is inserted from the top as seen in FIG. 7, which provides power to radially spaced lighting devices 14, which are diodes.

This patent states in column 4, "Since the light emitting diodes, the conductive pairs, the power source and associated electrical contacts are contained within the sport article itself, the inner surface contours of the article are not altered and thus do not effect the flight characteristics nor the ability of the recipient to grasp or feel the tossed sport article." Thus, this patent is relevant to that extent. The difference is that O'Riley does not support the four radial chemiluminescent devices on the top surface of the disc and does not suggest that the disc be translucent.

The Psyras, U.S. Pat. No. 4,132,031 and the Michael, U.S. Pat. No. 3,948,523, show battery powered lights in rotating discs, but in both there are elements that protrude downwardly below the lower surface of the discs.

The Peterson publication, US2003/0162470 A1 shows a disc having arcuate lighting elements snapped into the rim of the disc, which do not appear to affect flight aerodynamics. This device, however, appears to require custom tooling for the light 6.

The Chiang, U.S. Pat. No. 6,402,342, shows a battery powered lighting system for an aerodynamic disc that does not appear to protrude down into the cavity. However, the device is very complicated and requires clamshelling two disc parts together.

It is a primary object of the present invention to ameliorate the problems noted above in flying aerodynamic discs having chemiluminescent means for illuminating the disc.

SUMMARY OF THE PRESENT INVENTION

According to the present invention, an illuminatable aerodynamic translucent plastic disc is provided that spins in flight when thrown including chemiluminescent tube receiving clips that extend radially across the disc so that when the disc spins in darkness, the entire disc appears illuminated.

The central disc portion has a smooth lower surface that not only improves aerodynamics but also enhances finger spinning.

An important aspect of the present invention is that the chemiluminescent clips and tubes are on top of the discs and can be seen while the disc is spinning from below the disc because the disc itself is made out of a translucent, as opposed to opaque, plastic. Mounting the chemiluminescent tubes on top of the discs not only improves the aerodynamic characteristics of the disc, but more importantly provides a smooth surface on the bottom of the disc which is essential for competitive disc catching in which the disc is caught and spun on the receiver's finger like a basketball from underneath in gyroscopic spinning configuration.

Other objects and advantages of the present invention will appear more clearly from the following detailed description.

DETAILED DESCRIPTION OF THE PREFERRED EMBODIMENT

Figure 1:
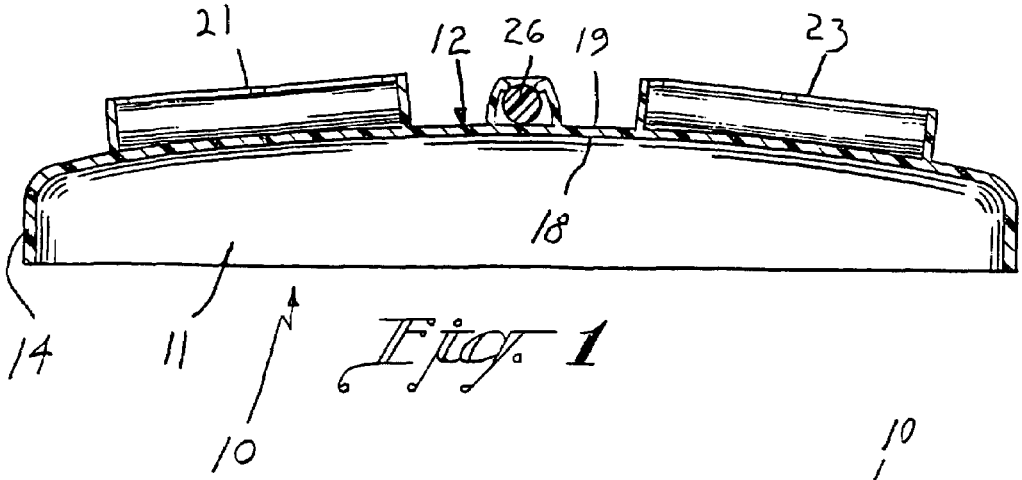
FIG. 1 is a cross section of the aerodynamic disc according to the present invention.
Figure 2:
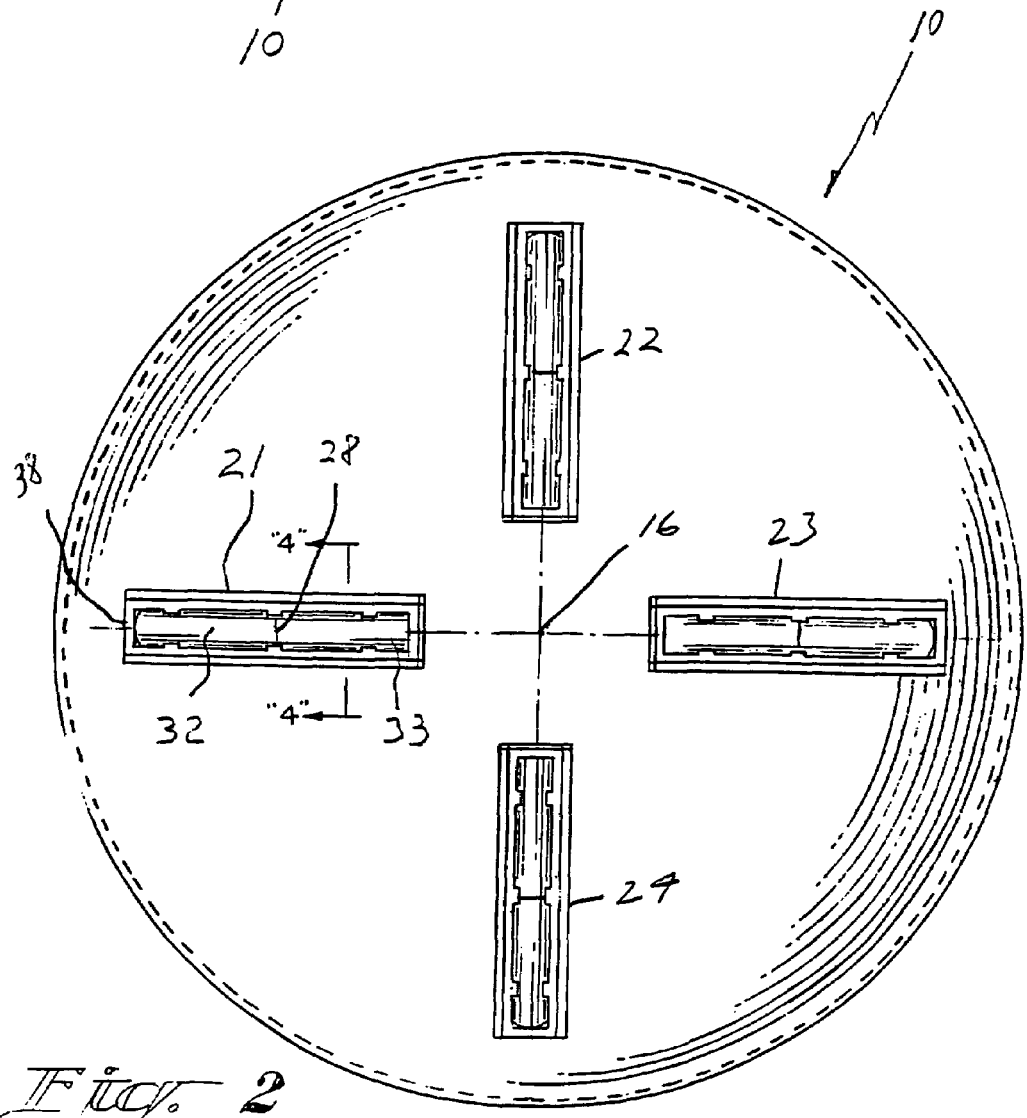
FIG. 2 is a top view of the aerodynamic disc illustrated in FIG. 1.

Referring to the drawings and particularly FIGS. 1 to 4, an annular or circular aerodynamic illuminatable disc is designated generally by the reference numeral 10 in the drawings according to the present invention and is seen to include a one-piece plastic molding 11 having a central disc portion 12 and an annular downwardly depending annular rim portion 14. The central disc portion 12 is slightly arcuate in all directions (that is, in any plane passing vertically through disc center axis 16 designated in FIG. 2, and has a smooth uninterrupted lower surface 18 and a parallel upper surface 19.

As seen in all the drawings, there are four integral chemiluminescent clips 21, 22, 23, and 24, that extend radially and spaced 45 degrees apart from one another on the top of the disc. The chemiluminescent tubes 26 held in position by the clips 21, 22, 23, and 24, are shown as solid cylindrical members in the drawings but in fact are tubular in configuration with a central frangible wall 28 that is broken to activate chemicals in separate chambers 32 and 33.

Figure 3:
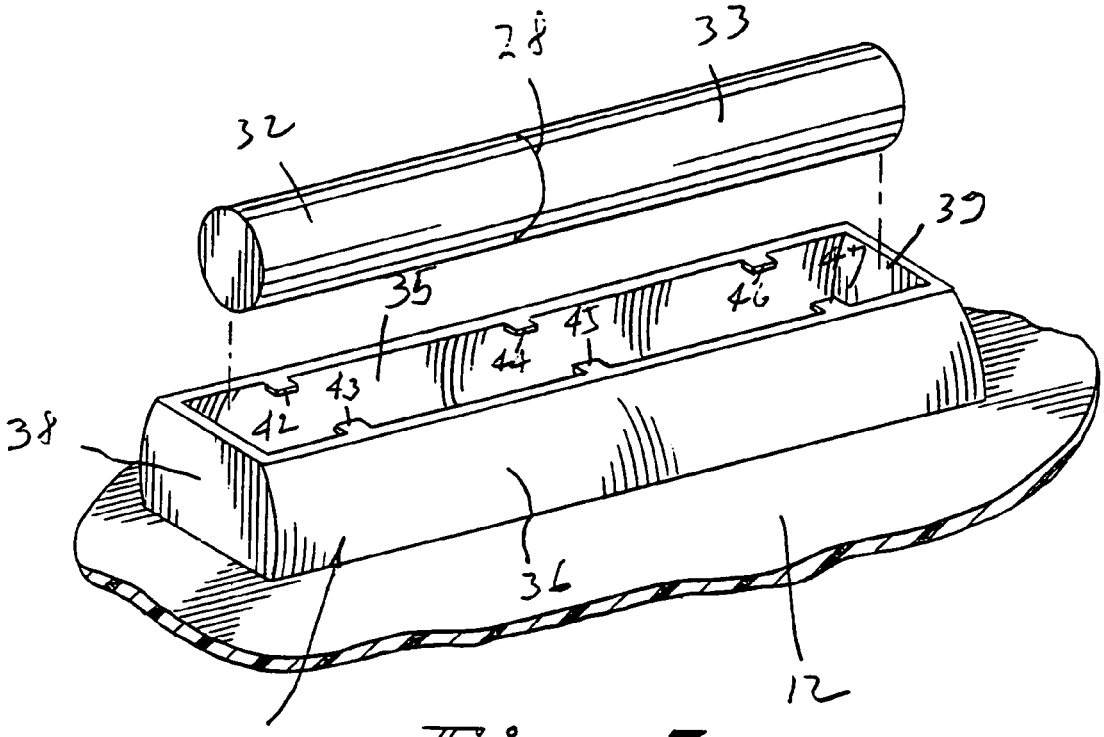
FIG. 3 is a fragmentary exploded view of one of the clips with the chemiluminescent tube shown prior to entry.
Figure 4:
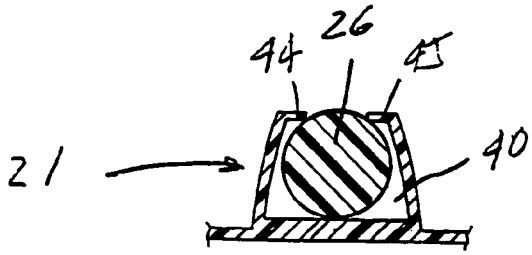
FIG. 4 is a cross-section taken generally along line 4-4 showing one chemiluminescent tube mounted inside one of the clips.

The clips are all identical so the description of clip 21 with respect to FIGS. 3 and 4, is understood to apply to the clips 22, 23 and 24 as well.

The clips 22 include upwardly and inwardly converging side walls 35 and 36 formed integrally with central disc portion 12, and end walls 38 and 39 integral with central disc portion 12 as well as the side walls 35 and 36. End wall 38 prevents the chemiluminescent tube 26 from exiting the clips under centrifugal force, and the tube 26 is assisted in being held in the clip recess 40 by tabs 42, 43, 44, 45, 46 and 47, formed integrally with and projecting inwardly over recess 40, and each being integral with one of the side walls 35 and 36. The tabs 42, 43, 44, 45, 46, and 47 are formed by a core piece in the shape of the cavity or recess 40, and these tabs are flexible enough to permit the withdrawal of that core piece from the recess 40 after the molding cycle for the disc 10 is completed.

The invention claimed is:

1. An illuminatable aerodynamic saucer, comprising: a generally annular plastic saucer having a generally flat disc portion with a central axis of rotation and a curved downwardly turned rim portion extending from the generally flat disc portion, said disc portion having a continuous top surface and a bottom surface, said bottom surface being smooth, continuous, and free of any downward protrusions, said disc portion top surface having a plurality of elongated clips completely above the top surface portion adapted to removably receive disposable chemiluminescent tubes, said clips having smooth continuous uninterrupted side walls to enhance aerodynamic performance.

2. An illuminatable aerodynamic saucer as defined in claim 1, wherein the elongated clips are integrally molded with the disc portion.

3. An illuminatable aerodynamic saucer as defined in claim 2, wherein each of the clips include a plurality of opposed converging fingers.

4. An illuminatable aerodynamic saucer as defined in claim 1, wherein the clips include an outer end wall engageable with the chemiluminescent tubes to retain the tubes in the saucer as the saucer rotates.

5. An illuminatable aerodynamic saucer as defined in claim 1, wherein the clips are radially disposed on the disc portion.

6. An illuminatable aerodynamic saucer as defined in claim 1, wherein the bottom surface of the disc portion is smooth.

7. An illuminatable aerodynamic saucer as defined in claim 1, wherein the saucer is constructed of a translucent material so light it radiates through and below the disc portion.

8. An illuminatable aerodynamic saucer, comprising: a generally annular plastic saucer having a generally flat disc portion with a central axis of rotation and a curved downwardly turned rim portion extending from the generally flat disc portion, said disc portion having a continuous top surface and a bottom surface, said bottom surface being smooth, continuous, and free of any downward protrusions, illumination means for illuminating substantially the entire saucer as it spins through the air including said disc portion top surface having a plurality of elongated clips completely above the top surface portion adapted to removably receive disposable chemiluminescent tubes, said clips having smooth continuous uninterrupted side walls to enhance aerodynamic performance.

9. An illuminatable aerodynamic saucer as defined in claim 8, wherein the elongated clips are integrally molded with the disc portion.

10. An illuminatable aerodynamic saucer as defined in claim 8, wherein each of the clips include a plurality of opposed converging fingers.

11. An illuminatable aerodynamic saucer as defined in claim 8, wherein the clips include an outer end wall engageable with the chemiluminescent tubes to retain the tubes in the saucer as the saucer rotates.

12. An illuminatable aerodynamic saucer as defined in claim 8, wherein the saucer is constructed of a translucent material so light it radiates through and below the disc portion.

13. An illuminatable aerodynamic saucer, comprising: a generally annular plastic saucer having a generally flat disc portion with a central axis of rotation and a curved downwardly turned rim portion extending from the generally flat disc portion, said disc portion having a top surface and a bottom surface, said bottom surface being smooth, continuous, and free of any downward protrusions, illumination means for illuminating substantially the entire saucer as it spins through the air including said disc portion having a plurality of elongated clips completely above the top surface portion adapted to removably receive disposable chemiluminescent tubes, said clips having smooth and continuous uninterrupted side walls to enhance aerodynamic performance, the saucer being constructed of a translucent material so light radiates through and below the disc portion.

* * * * *